US006619461B2

(12) United States Patent
Saltsov et al.

(10) Patent No.: US 6,619,461 B2
(45) Date of Patent: Sep. 16, 2003

(54) VALIDATOR WITH REMOVABLE POWER INTERFACE

(75) Inventors: Leon Saltsov, Thornhill (CA); Sergiy Bukhman, Toronto (CA)

(73) Assignee: Cashcode Company Inc., Concord (CA)

( * ) Notice: Subject to any disclaimer, the term of this patent is extended or adjusted under 35 U.S.C. 154(b) by 8 days.

(21) Appl. No.: 09/974,889

(22) Filed: Oct. 12, 2001

(65) Prior Publication Data

US 2002/0066636 A1 Jun. 6, 2002

(30) Foreign Application Priority Data

Oct. 17, 2000 (CA) ..... 2323377

(51) Int. Cl.[7] ..... G07F 9/10
(52) U.S. Cl. ..... 194/317; 194/350; 194/328
(58) Field of Search ..... 194/350, 317, 194/205, 328, 344; 235/379, 380

(56) References Cited

U.S. PATENT DOCUMENTS

| | | | | | |
|---|---|---|---|---|---|
| 5,405,131 | A | * | 4/1995 | Zouzoulas | 271/181 |
| 5,676,231 | A | * | 10/1997 | Legras et al. | 194/206 |
| 5,907,141 | A | * | 5/1999 | Deaville et al. | 235/375 |
| 5,993,317 | A | * | 11/1999 | Majima | 463/29 |
| 5,996,888 | A | * | 12/1999 | Gromatzky | 232/15 |
| 6,067,530 | A | * | 5/2000 | Brooks et al. | 705/30 |

FOREIGN PATENT DOCUMENTS

| | | | | |
|---|---|---|---|---|
| JP | 54-108698 | * | 8/1979 | G07F/0/06 |

* cited by examiner

*Primary Examiner*—Donald P. Walsh
*Assistant Examiner*—Mark J Beauchaine

(57) ABSTRACT

The modular validator includes a frame body which acts as an intermediary for releasably securing and releasably electrically connecting a series of modular components. In particular, a releasable power interface cooperates with the frame body and a releasable validating head. The frame body allows each of the components to be separately removable and also provides electrical connection between the validator and a host device.

9 Claims, 7 Drawing Sheets

VALIDATOR WITH REMOVABLE POWER INTERFACE

FIELD OF THE INVENTION

The present application relates to a validator having a removable power interface module which is removable from the validator, separate and apart from a validating head.

BACKGROUND OF THE INVENTION

Banknote validators carry out investigations on a received banknote and if acceptable, process the banknote by forwarding the banknote to a banknote cassette or a banknote accumulator. The validators are used in vending or dispensing devices such as gaming machines, food vending machines and automated point of purchase terminals, as but a few examples.

The validator is in communication with the host device and receives power from the host device. As can be appreciated, there are many manufacturers of the different host devices and the power available in different host devices varies considerably between devices, as well as between different manufacturers and between different countries. In order to allow the validator to receive power from the host device and to communicate with the host device, a power interface has been used which has typically been associated with the validating head.

Each validating head was designed to comply with the power available and the characteristics of the host device. This procedure necessitates stocking different validating heads for each application.

SUMMARY OF THE INVENTION

The present invention recognizes that a number of advantages can be accomplished by having a particular modular design where various components connect with a body or frame member and preferrably, this body or frame member includes electrical connectors for connecting with the associated host device. In this way, different validating heads can connect with the frame as well as a separate and removable power interface cooperates with the frame. With this structure, the appropriate power interface can be provided for the device while maintaining the same validating head. Thus, the validating interface is adapted for the associate host device and provides appropriate power conversion for the validating head.

A validator according to the present invention comprises a frame body which releasably receives a validating head, a removable cassette, and a removable power interface. The removable power interface provides appropriate power conversion and communication channels between the validating head and the intended host device in which the validator will be installed.

According to an aspect of the invention, the frame body includes electrical means for connecting the validator to the host device.

According to a further aspect of the invention, the electrical means includes an electrical connector for connecting the validator to an associated host device and the electrical connector is secured on the frame body.

In a further aspect of the invention, the electrical means includes an electrical plug connector of the validating head received in an electrical plug connector of the frame body. The removable power interface also includes an electrical connector received in an electrical connector of the frame body. The electrical connectors of the frame body are interconnected to provide appropriate power from the power interface to the validating head, as well as communication paths for the validating head to the host device.

In yet a further aspect of the invention, the power interface module includes a lever actuator which cooperates with the body frame to move the power interface from a release position allowing removal of the power interface to an engaged position with the electrical connector of the interface in engagement with the connector of the frame body and mechanically fastened to the frame body.

In yet a further aspect of the invention, the lever actuator cooperates with at least one stationary roller on the frame body.

According to yet a further aspect of the invention, the power interface module slides in a first direction to an initial position in the frame body in preparation for electrical connection of the connectors and moves in a second direction controlled by the lever actuator to a connected position where the connectors are connected.

With the modular design of the validator, the validating head and the power interface function have been separated and it is much more convenient to replace certain parts when failure can occur. For example, in prior art designs when the validating head and power interface module are integral, failure of any of these components requires the entire validating head and interface module to be replaced. This is expensive and even if replacement parts are available, there is considerable expense involved.

In addition, with the present design, the validator may be modified for use with a different host device by replacing the particular power interface module. This modular design provides advantages for both the user and the manufactures. Validating heads can be appropriately modified with different sensors and software for evaluating different currencies or banknote denominations can be manufactured, while separate power interface modules for these validating heads to allow them to interact with different host machines can be manufactured and stock piled separately.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
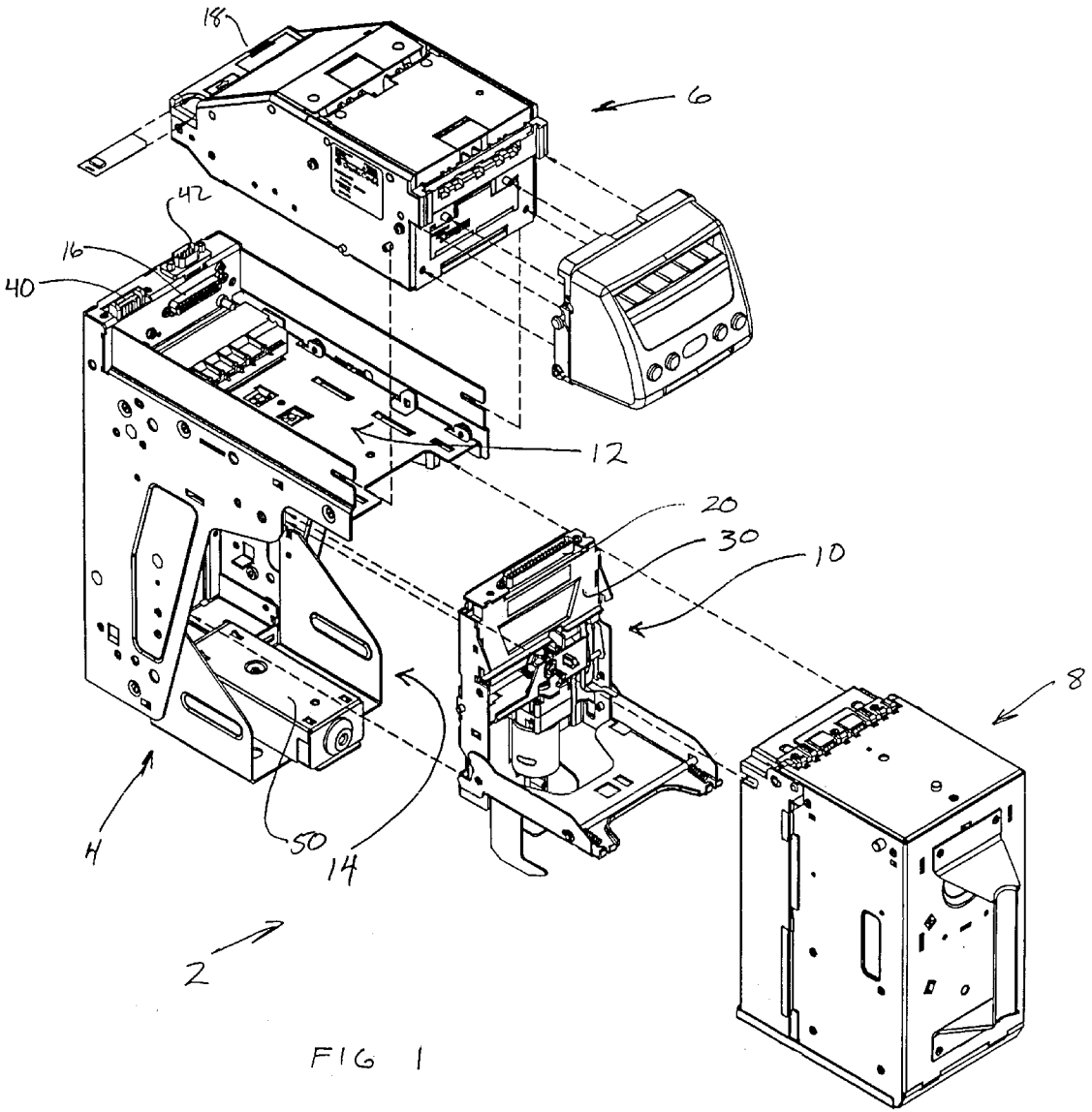
FIG. 1 is an exploded perspective view of the validator showing the various modular components.
Figure 2:
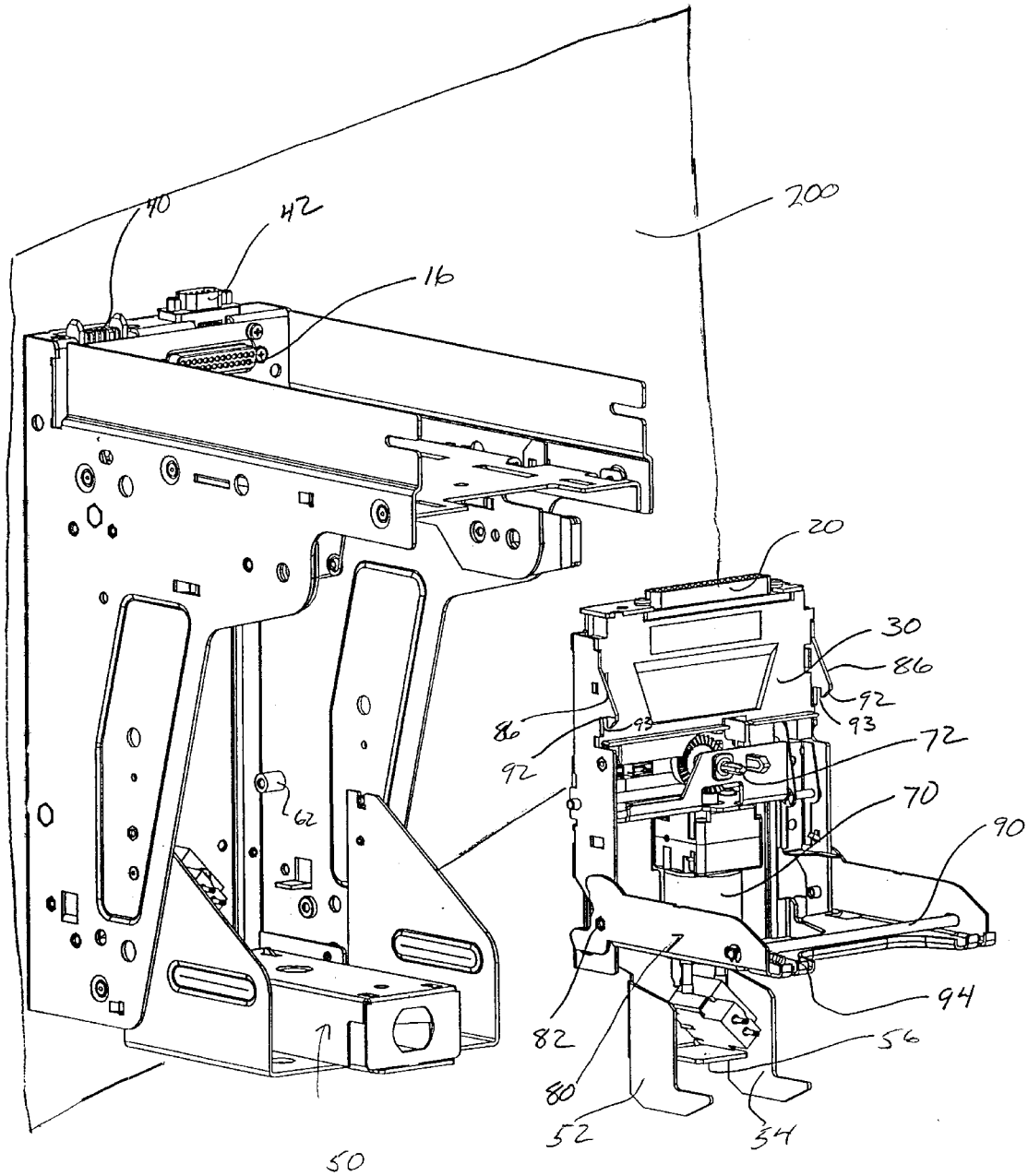
FIG. 2 is an exploded perspective view showing the frame body and the removable power interface.

The validator 2, as shown in FIGS. 1 and 2, is of a modular design and has a series of releasable components which are received and maintained in the frame body 4. The validating head 6 is releasably received in a validator head slot 12 of the frame body 4 and locks with the frame body. An electrical connector 18 on a back edge of the validating head connects with the electrical connector 16 provided at the rear of the validator head slot. Insertion of the validating head 6 into the frame body results in connection of the multi pin connectors 16 and 18.

The removable power interface 10 includes its own electrical connector 20 as well as conversion electronics generally indicated as 30. The power interface 10 is inserted into the rear of the power interface slot 14 and is then moved vertically to cause a connection of electrical connector 20 with a similar connector provided on the body frame. Pivotting lever 80 of the power interface is swung upwardly pivotting about point 82 and causing the power interface to move vertically due to engagement with the frame body 4. The pivotting lever 80 locks with the power interface and is maintained in a vertical position. After the power interface has been installed in the frame body 4, the removable cassette 8 can be received in the body frame member generally immediately in front of the power interface module. A host device 200 is schematically shown in FIG. 2.

Figure 3:
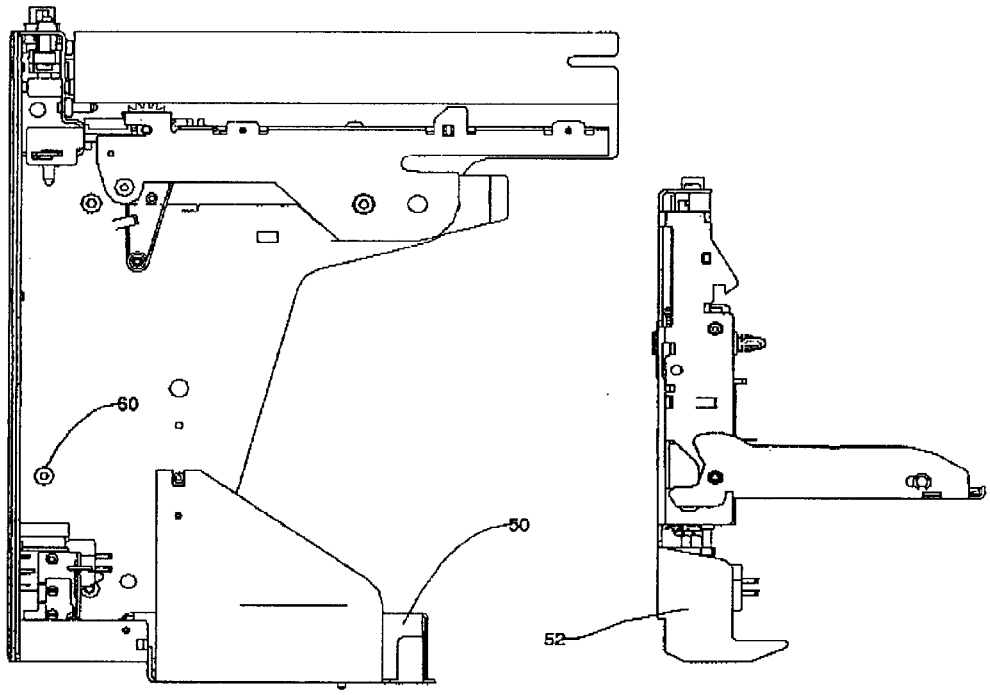
FIG. 3 is a side view similar to the perspective view of FIG. 2 showing the interface about to be inserted in the frame body.
Figure 4:
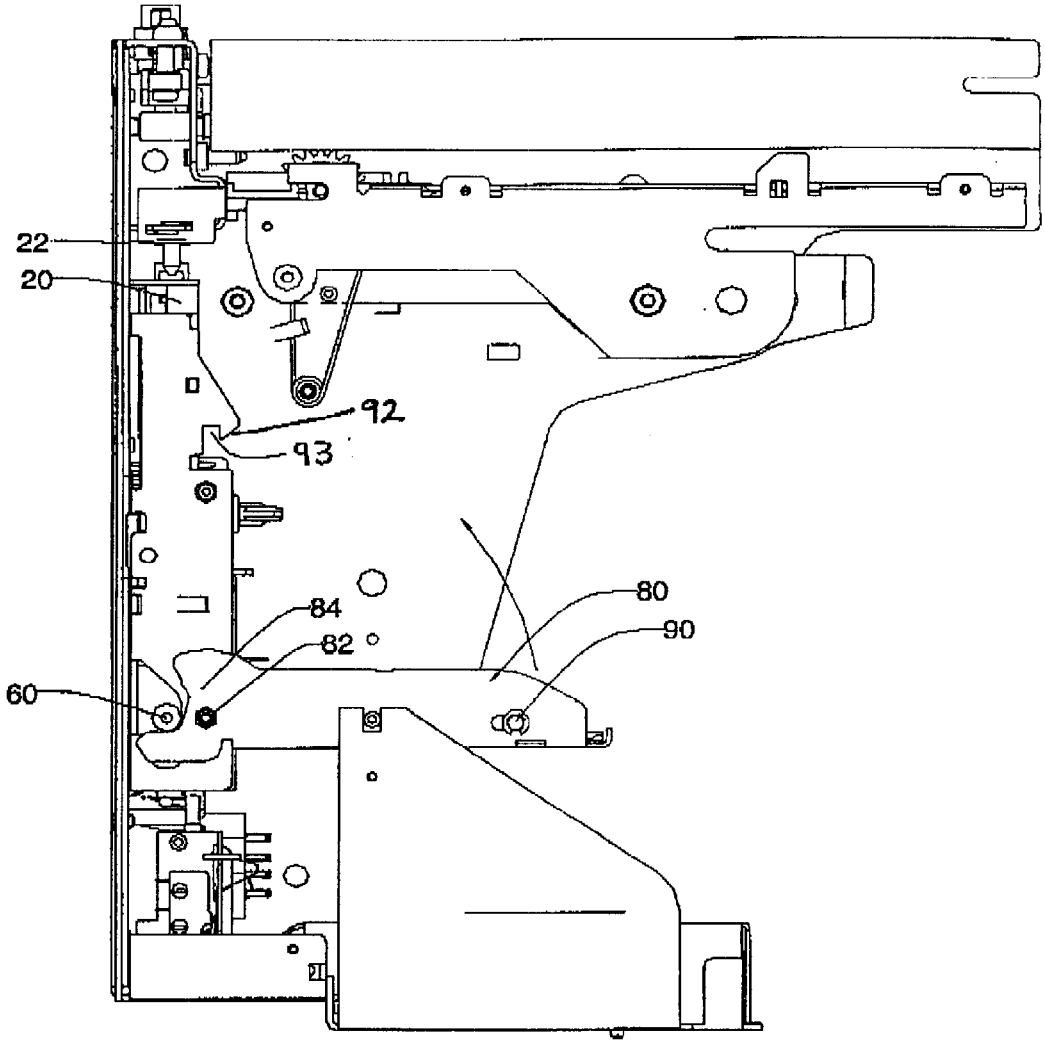
FIG. 4 is a side view showing the power interface initially inserted in the frame body and about to be moved to a connected position.
Figure 5:
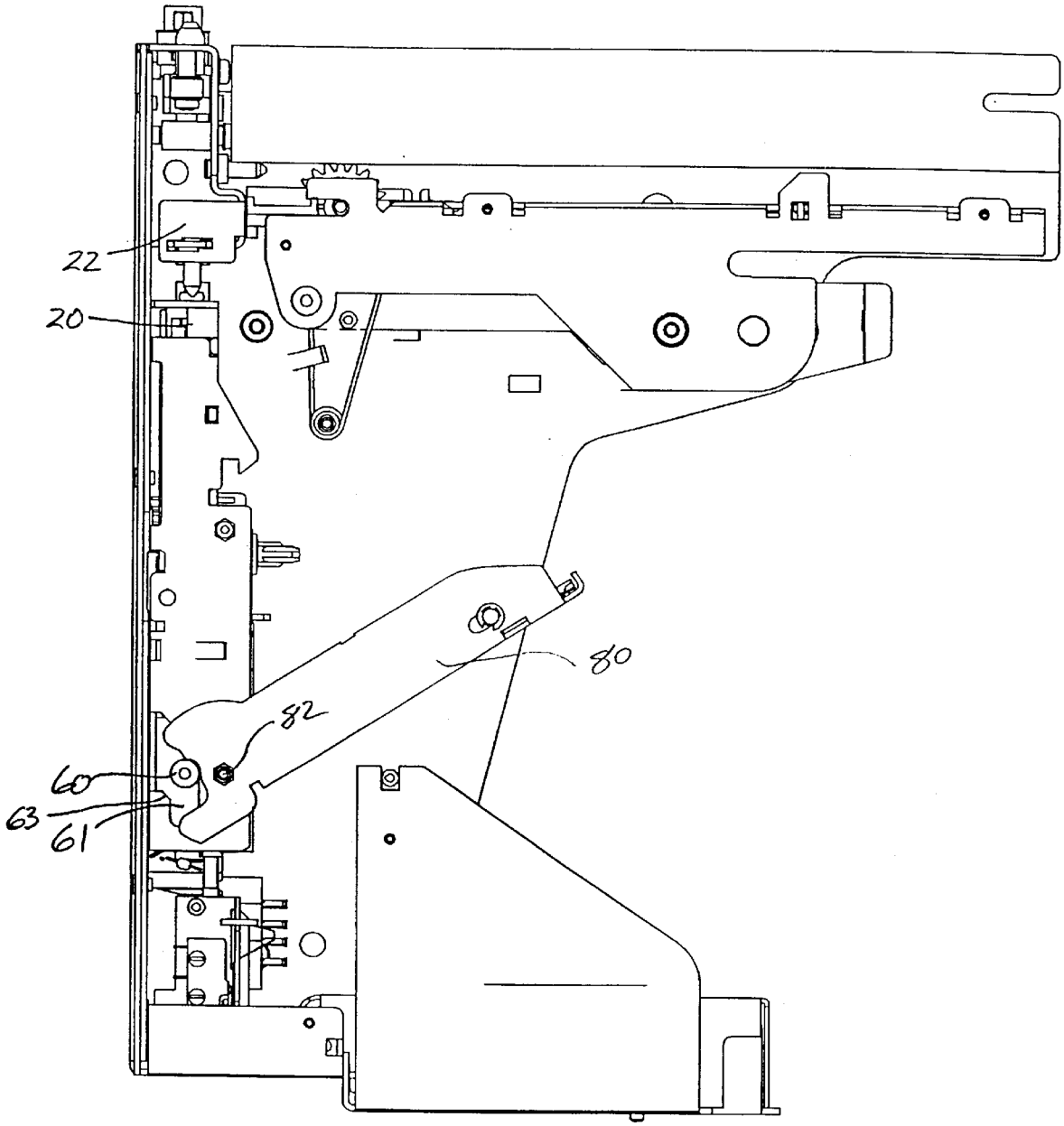
FIG. 5 is a side view similar to FIG. 4 showing the actuating lever being pivotted upwards and forcing the power interface to a connected position.

Insertion of the power interface 10 into the frame body 4 is shown in FIGS. 3, 4 and 5. The power interface 10 includes opposed feet 52 and 54 which project downwardly from the power interface and in combination with the horizontal plate 56, define a downwardly opening U-shaped channel. These components form a slide surface which allows the power interface to be inserted into the frame body 4. This downwardly opening channel is supported by the slide rail 50 of the body frame member and guided to the rear of the frame body 4.

As can be seen, to install the power interface, the pivotting lever 80 is initially in a horizontal position. The power interface is moved to an initial position as shown in FIG. 4. The pivotting lever 80 is in contact with roller 60 at a fixed position on the body frame member 4. This roller 60 extends from one side wall of the body frame member and the power interface is ported on the rear surface to allow the roller to engage the stop and cam face 84 of the lever. As can be seen, the power interface is in a lower position and electrical connector 20 at the upper edge of the power interface is not yet in engagement with the connector 22 of the frame body 4.

Figure 6:
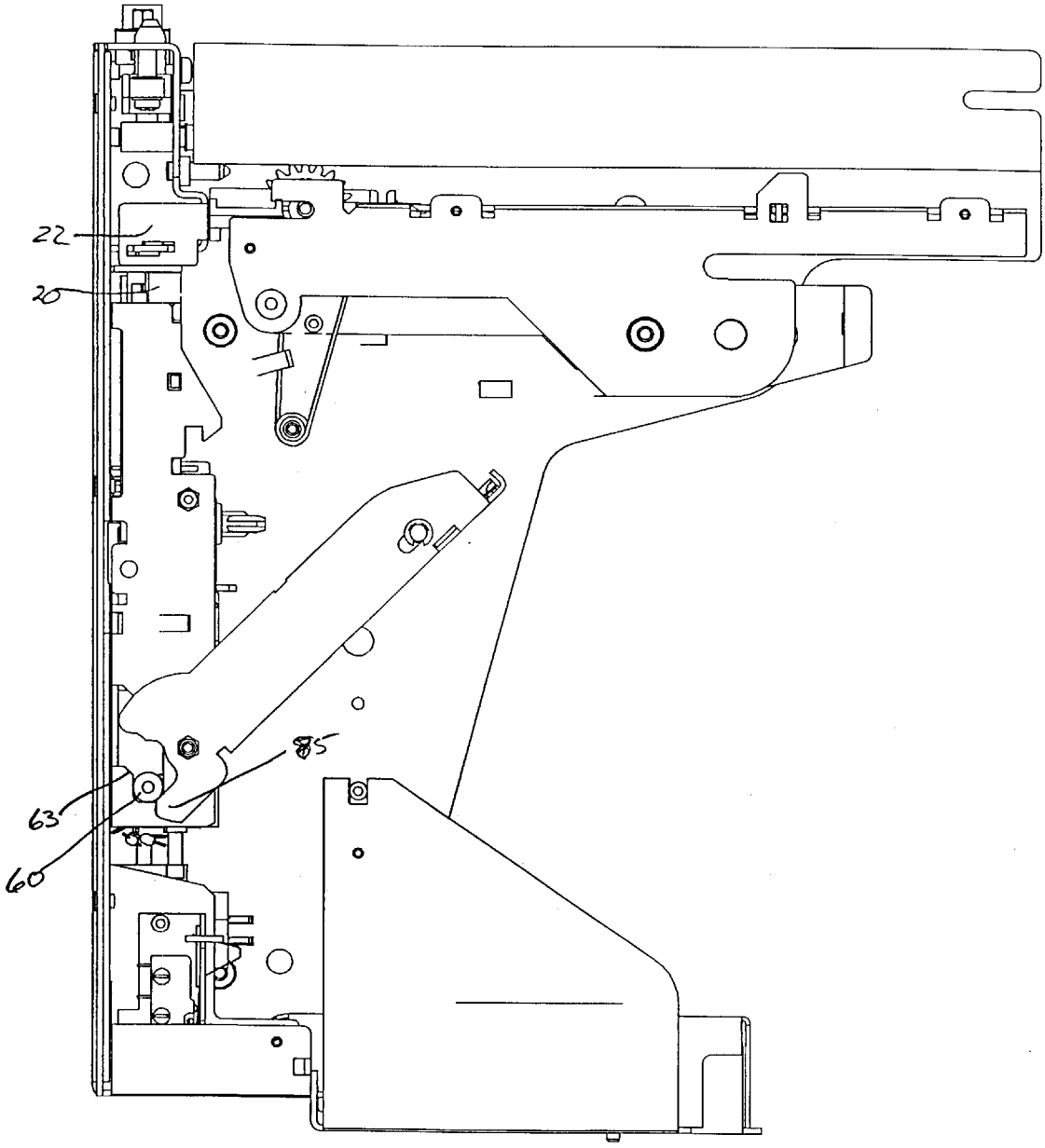
FIG. 6 is a side view showing a power interface in a connected position with the lever being moved downwardly to allow removal of the power interface.

In FIG. 4 the lever 80 has been partially rotated counterclockwise about pivot point 82 and this action has caused the cam face 84 to engage roller 60 and start to move the power interface module vertically. Further rotation of the pivotting lever 80 to the vertical position will cause roller 60 to engage in the slot 61 of the power interface, partially fastening the power interface to the frame body 4. Thus, the lever 80 in combination with the roller 60 and a similar roller 62 on the opposite side of the body frame member causes movement of the power interface vertically connecting electrical connectors 20 and 22. The fully connected position is shown in FIG. 6. In this case, the pivotting lever 80 has been released and is starting to be rotated clockwise and will eventually cause the power interface module to move downwardly and break the connection between the electrical connector 20 and the electrical connector 22.

The slot 61 of the power interface module also includes a cam surface 63 which will engage the roller 60 and guide the power interface 10 into abutment with the rear of the frame body 4.

As shown in FIG. 6, continued movement of the pivotting lever 80 in a clockwise direction will cause projecting lever 85 to engage roller 60 forcing the power interface 10 to move downwardly and break the connection between connector 20 and connector 22. Once the lever has assumed a horizontal position, the power interface is free to move forwardly out of the frame body 4.

In the specific example shown, the power interface function is carried out by the power conversion electronics 30. Preferrably, the power interface also includes a drive motor 70 and a particular drive transmission arrangement for drive shaft 72. This provides power for the banknote stacking mechanism provided in the cassette 8. It is convenient to associate the power interface conversion electronics with this drive motor 70 and drive shaft 72. However, it can be appreciated that these components can be separated and each of these components could be separately removable from the frame body 4. Generally, the power interface electronics and this motor drive and transmission do not cause problems and it is more likely problems occur, that these problems are associated with the validating head. It is also possible for this drive motor and drive transmission to be separated from the power interface once it has been removed from the frame body 4.

With the present design, the validating head is separately removable from the power interface module and a new validating head may be inserted. The removal of the validating head is convenient as the electronic connections to the host device are maintained and insertion of a new validating head effectively connects the power interface module to the validating head as well as the validating head to the host device. This benefit is also present if problems occur with the power interface which requires its replacement.

Communication to the host device and to other devices (such as smart card readers) of the host device can be accomplished through electrical connections associated with the frame body 4. As shown in FIGS. 1 and 2 the frame body 4 includes an electrical connector 40 for connection to a host device such as a gaming machine, a vending machine, or a point of purchase terminal, and connector 42 allows the validator to connect with other devices such as a smart card reader or coin dispenser as two examples. Thus the body frame 4 has been provided with the electrical connections to the particular host device and associated devices and components of the validator can be replaced without changing these electrical connections.

For example, if there is a problem with the validating head, it can be removed from the frame body 4 and a new validating head inserted and appropriate communication is accomplished due to electrical connection 16 engaging the corresponding electrical connection 18 of the validating head. In the case of a problem associated with the power interface 10, the replacement power interface will have a connector 20 which engages connector 22 of the frame body 4. Any connections between connector 40 and the host device and connector 42, and an associated device, are maintained.

The pivotting lever 80 includes a bar release 90 biased by spring 94 to one end of a slot within the pivoting lever 80. As the pivoting lever 80 is rotated to the position, bar 90 strikes the latch 86 either side of the conversion electronics 30 and the cam surface 92 urges the bar to move downwardly against the spring bias 94 until the bar is free to enter the slot 93 of the latch. Once the bar 90 is received within the slot 93 of the latch, the lever is locked in the vertical position. To remove the power interface 10, the bar 90 is moved downwardly by the service technician, and then pivotted downwardly and released from the frame body.

Figure 7:
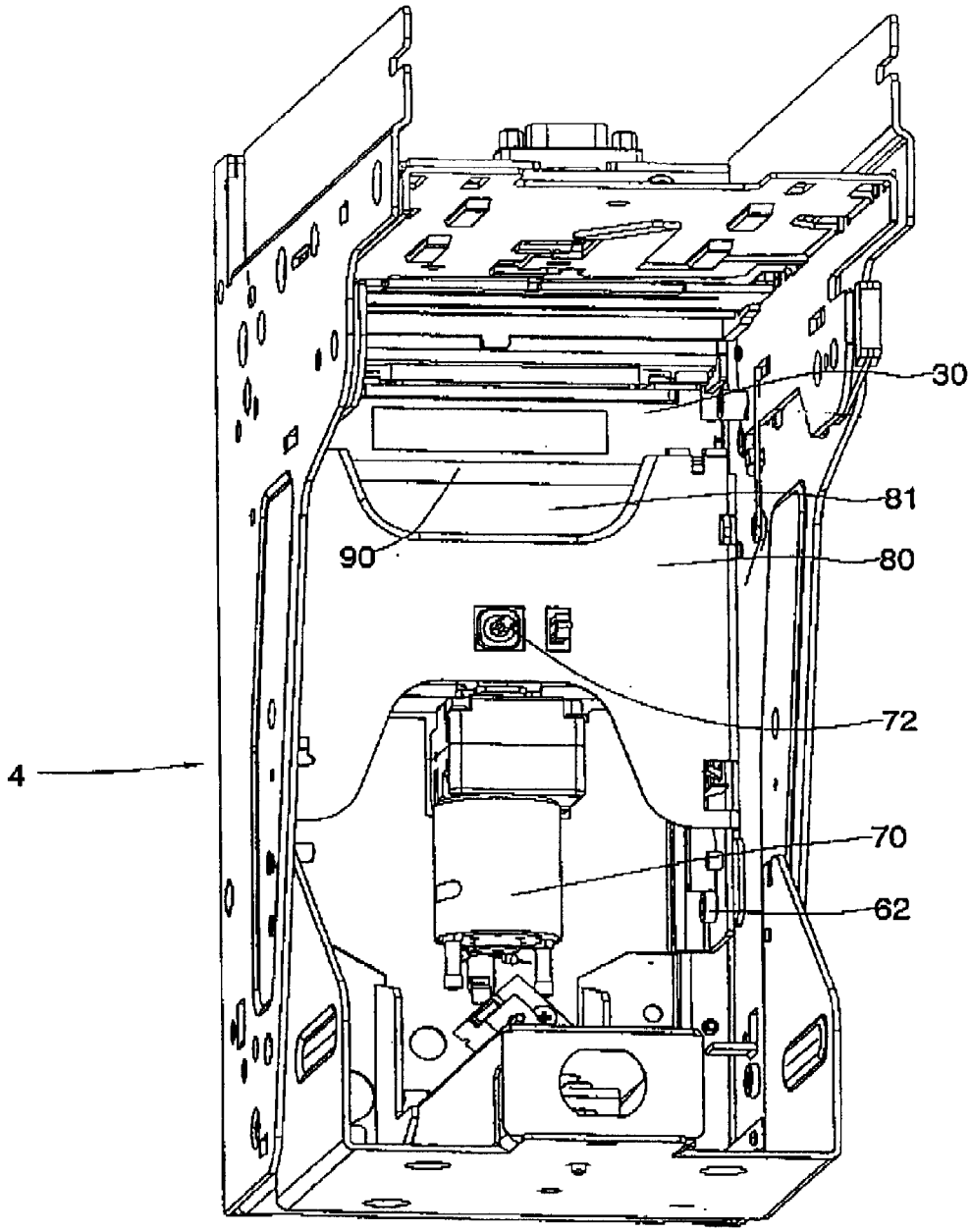
FIG. 7 is a perspective view of the power interface received in the frame body of the validator.

FIG. 7 shows the power interface 10 fully received in the frame body 4 with the pivotting lever 80 locking the power interface to the body frame 4. As evident from FIG. 7, the pivotting lever 80 has a cut out region 81 to provide easy access to the release and lock bar 90.

At the present point in time, approximately eight different power interfaces are manufactured for different applications and these power interfaces can also cooperate with certain electronic security components such as a Dallas chip located on the removable banknote cassette 8. Some of these power interfaces are designed to cooperate with a 24 volt host machine and other power modules are designed for cooperation for 12 volt machines. Although not normally the case, it can be appreciated there can be different body frame members 4 having different electrical connections 40 and 42 for cooperation with different host machines. In this way, the validator can easily be customized from a stock of the different modular components for use with a particular host device as well as a particular user requirement. This provides great versatility in addressing the requirements of different machines provided in different applications as well as different countries.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A banknote validator comprising a plurality of releasable components secured in a frame body;

said releasable components including a validating head for receiving and determining the authenticity of a banknote, a banknote storage arrangement for receiving banknotes accepted by said validator, a power interface module;

said validator including electrical means for connecting said validator to an associated device allowing communication therebetween and providing power to said power interface module, said power interface module providing any power conversion necessary for powering of said validating head.

2. A banknote validator as claimed in claim 1 wherein said frame body includes said electrical means for connecting said validator to such associated device.

3. A banknote validator as claimed in claim 1 wherein said electrical means includes an electrical connector for connecting said validator to an associated device and said electrical connector is secured on said frame body.

4. A banknote validator as claimed in claim 3 wherein said electrical means includes an electrical plug connector of said validator head received in an electrical plug connector of said frame body.

5. A banknote validator as claimed in claim 4 wherein said power interface module includes an electrical connector received in an electrical connector of said frame body.

6. A banknote validator as claimed in claim 5 wherein said power interface module includes a lever actuator which cooperates with said body frame to move said power interface module from a release position allowing removal of said power interface module to an engaged position where said electrical connector of said interface module is in engagement with said connector of said frame body.

7. A banknote validator as claimed in claim 6 wherein said lever actuator cooperates with a stationary roller of said frame body.

8. A banknote validator as claimed in claim 7 wherein said power interface module is slidably received in said frame body.

9. A banknote validator as claimed in claim 8 wherein said power interface module slides in a first direction to an initial position in preparation for electrical connection of said connectors and moves in a second direction to a connected position where said connectors are connected.

* * * * *